United States Patent [19]

Eigenbrode

[11] 4,025,151

[45] May 24, 1977

[54] CONNECTOR BLOCK

[75] Inventor: George Thomas Eigenbrode, Mechanicsburg, Pa.

[73] Assignee: E. I. Du Pont de Nemours and Company, Wilmington, Del.

[22] Filed: Jan. 12, 1976

[21] Appl. No.: 648,513

[52] U.S. Cl. ..... 339/210 M

[51] Int. Cl.[2] ..... H01R 13/40

[58] Field of Search ..... 29/629; 339/206 R, 206 P, 339/207, 209, 210, 220, 59 R, 59 M, 210 M

[56] References Cited

UNITED STATES PATENTS

| | | | |
|---|---|---|---|
| 3,668,615 | 6/1972 | Bury | 29/629 |
| 3,680,035 | 7/1972 | Teagno et al. | 339/210 M |
| 3,693,134 | 9/1972 | Trevisiol | 339/184 M |
| 3,697,933 | 10/1972 | Black et al. | 339/192 R |
| 3,835,445 | 9/1974 | Hardesty | 29/629 |
| R28,147 | 9/1974 | Hoffman | 339/59 M |

FOREIGN PATENTS OR APPLICATIONS

| | | | |
|---|---|---|---|
| 2,424,898 | 12/1974 | Germany | 339/210 M |
| 1,315,693 | 5/1973 | United Kingdom | 339/59 M |

*Primary Examiner*—Ronald J. Shore
*Assistant Examiner*—John McQuade

[57] ABSTRACT

A connector block molded of glass-filled thermo-plastic includes an integral gate extending along the ends of a row of cavities. The gate is connected to the block by a hinge portion having opposed resin rich surface layers and a rigid glass fiber-resin composite between the layers. Upon movement of the gate toward a position where it closes the adjacent ends of the cavities, one resin layer and the composite in the hinged portion break permitting retention of the gate about the remaining flexible layer to close the ends of the cavities.

9 Claims, 5 Drawing Figures

FIG. 1
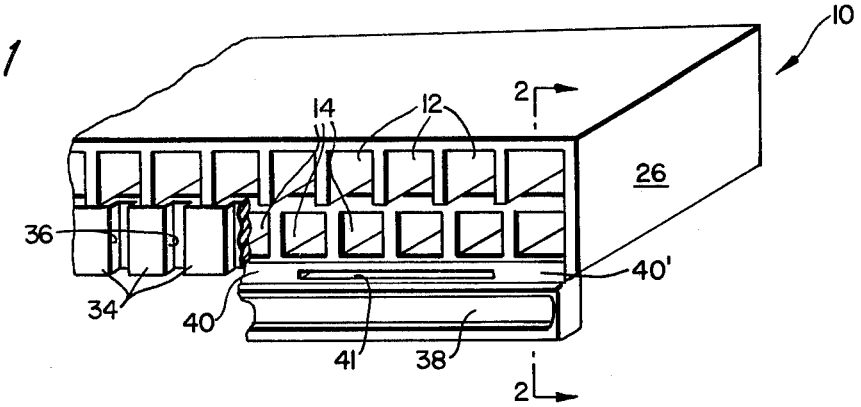
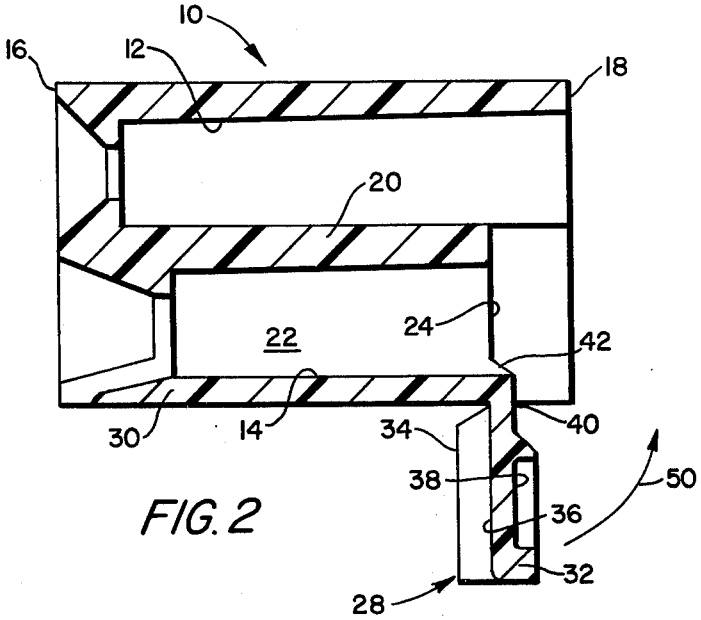
FIG. 2
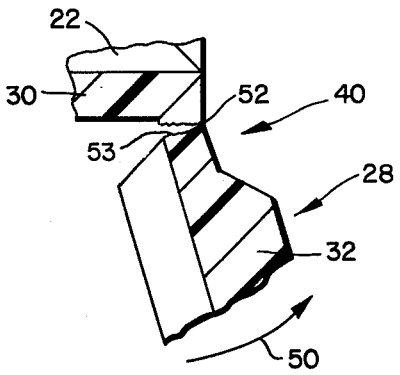
FIG. 3
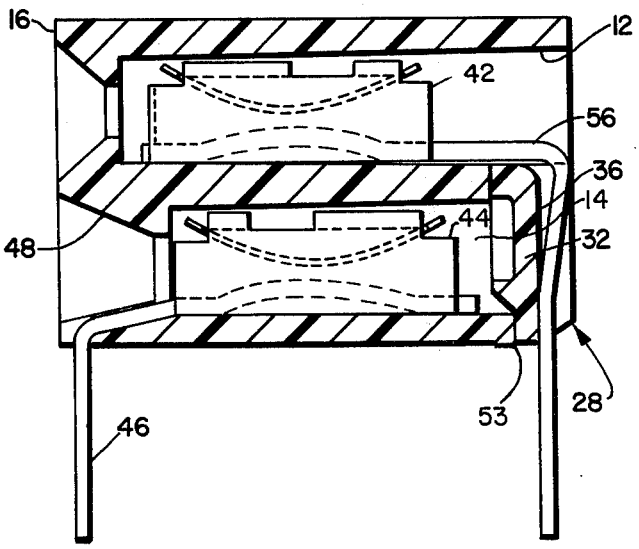
FIG. 4
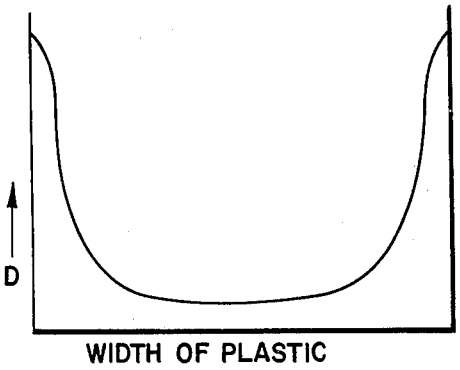
FIG. 5

CONNECTOR BLOCK

The invention relates to molded connector blocks, particularly to connector blocks for receiving electrical disconnect-type contact terminals where the block is molded from a filled thermo-plastic and the open insertion ends of cavities in the block are closed by an integral molded gate rotated to the closed portion about a flexible resin surface layer.

Connector blocks are used to house disconnect terminals, or other elements as desired. The terminals are inserted into open ended cavities formed within the blocks and are confined within the cavities for engagement with contacts, conventionally leads, which are inserted into the cavities. In the case of blocks molded from flexible thermo-plastic the terminals may be confined in the cavities by means of integral molded flexible latches which are depressed during insertion and which snap back behind the terminals when the terminals are fully seated in the cavities. Alternatively, a blocking tongue integral with the block and connected to the block through a flexible thermo-plastic strip may be inserted behind the terminals to hold them in place. See U.S. Pat. No. 3,693,134.

Flexible latches and blocking tongues cannot be used to confine terminals in cavities in connector blocks molded of glass filled or otherwise filled thermo-plastic material because the filling renders the molded plastic rigid. For this reason, terminals are confined in cavities in these types of blocks by the use of separate blocking pieces which are secured to the block following insertion of the terminals to close the terminal-receiving cavities. See U.S. Pat. No. 3,697,933 which discloses the use of locking pins and strips. The separate pieces conventionally required to retain terminals in cavities in glass filled thermo-plastic blocks increase manufacturing and storage costs. Increased labor is required to position these pieces on the block following insertion of the terminals.

The connector block according to the invention is molded from a thermo-plastic material with a filler, conventionally a fiberglass although other fillers are contemplated. The block includes an integrally molded gate extending from one side adjacent the open ends of one row of terminal-receiving cavities. The gate is secured to the block by a rigid gate portion having thin resin rich layers at its opposed surfaces and a rigid resin-filling composite between the layers. When the gate is rotated toward the closed position at the ends of the cavities one resin layer and the composite are ruptured by the tensil force allowing the gate to rotate to the closed position about the remaining flexible resin rich layer. In this way, an integral portion of the molded block may be moved to a closed position confining the terminals in the cavities without the necessity of using loose piece parts. Production, storage and labor costs are reduced over conventional filled thermo-plastic blocks with inserted closing members.

Other objects and features of the invention will become apparent as the description proceeds, especially when taken in conjunction with the accompanying drawings illustrating the invention, of which there is one sheet.

IN THE DRAWINGS

FIG. 1 is a perspective view of a block according to the invention with the locking gate shown in open and closed positions;

FIG. 2 is a sectional view taken along line 2—2 of FIG. 1;

FIG. 3 is an enlarged fragmentary view of a portion of FIG. 2 illustrating rupture of the hinge portion upon rotation of the gate toward the closed position;

FIG. 4 is a view like FIG. 2 following loading of terminals into the cavities and closure of the gate; and FIG. 5 is a graph illustrating the resin density across the thickness of the hinged portion at the gate.

Connector block 10 is molded from a fiber glass-filled thermo-plastic such as a polyester and includes an upper row of terminal cavities 12 and the lower row of terminal cavities 14 with each cavity 12 located immediately above a cavity 14. The cavities 12 and 14 extend between block front wall 16 and rear wall 18 as illustrated in FIG. 2. The wall 20 between the upper and lower rows of cavities 12 and 14 and the side walls 22 separating cavities 14 in the lower row are both cut back from rear wall 18 to define a gate-receiving recess 24 extending along the length of the block between the end walls 26, only one of which is shown.

As illustrated in FIG. 2, gate 28 is an integral molded part of block 10 joining the block at bottom wall 30 and including an elongate strip 32 extending the length of recess 24 between end walls 26 with a series of spaced projections 34 extending across the width of the strip on the side thereof facing away from rear wall 18. The spaced projections 34 defining terminal-tail receiving slots 36 extending across the strip 32. A central lead-receiving recess 38 is provided on the side of the strip away from projections 34. The recess 38 extends essentially the length of the strip as illustrated in FIG. 1.

The strip is integrally molded as a part of block 10 and is joined to the bottom wall 30 at a number of spaced hinge portions 40. Portions 40 are spaced along the block to reduce the force rendered to rotate the gate into the recess 24 and to provide openings 41 between adjacent portions. These openings permit molding of block stand-offs on the lower surface of wall 30. Wall 30 extends slightly beyond the ends of the side walls 22 between adjacent cavities 14 which include angled strengthening portions 42 extending outwardly from the wall ends to the edge of wall 30. These portions assure that upon rotation of the gate 28 toward recess 24 the glass-filled thermo-plastic ruptures at the hinged portions 40 as will be described hereinafter in further detail.

FIG. 5 is a graph having an abscissa indicating the width of a molded piece of glass-filled thermo-plastic material and an ordinate indicating the density of resin in the plastic. The abscissa extends from one molded surface across the width of the plastic to the other surface. As indicated in the graph, the density of thermo-plastic resin increases very markedly at the molded surfaces and decreases toward the central composite portion of the molded part which has a very high density of filler. The thermo-plastic resin rich surface layers are relatively flexible while the central portion of the plastic which is filled with fiberglass strengthening material is rigid and imparts a desired inflexibility to the entire molded piece. Other fillers, besides glass fibers, such as carbon fibers or glass balls, may be used to strengthen the thermo-plastic as desired.

Terminals 44 are inserted into cavities 14 through the openings adjacent the rear wall of the connector block so that the terminals are seated as shown in FIG. 4 with forwardly projecting terminal tails 46 extending outwardly of the block through slots provided in the bottoms of lead-receiving openings 48 formed in front wall 16. The tails 46 are bent down to facilitate subsequent mounting of the fully loaded block on a circuit board. The terminals 44 are seated against the ends of the cavities at openings 48.

Following loading of terminals 44 into recesses 14 the integral molded gate 28 is rotated about hinge portions 40 in the direction of arrow 50 shown in FIG. 2 toward gate-receiving recesses 24. This rotational force on the gate subjects the resin rich layers on the surface of the hinge portions 40 adjacent projections 34 and the fiberglass-filled central parts of the hinge portions to tensile forces which rupture the layers and central parts of the hinge portions as illustrated in FIG. 3 allowing for the gate to be rotated into the recess 24 about the remaining integral flexible resin rich layers 52 on the side of the gate facing rear wall 18. See FIG. 3 which illustrates the tensile rupture 53 extending across the width of the hinge portions 40 to layer 52. The layers 52 form flexible hinges joining the gate to the block and permitting rotation of the gate into the recess. While repeated flexing of the layers 52 will break the layers, they have sufficient strength to permit rotating of the gate 180° into the recess as illustrated in FIG. 4. In this position, the gate closes the ends of lower cavities 14 as illustrated.

Terminals 42 are then loaded into the upper cavities 12 and the tails 56 extending outwardly therefrom at the rear wall 18 of block 10 are bent down from the cavities 12 in the slots 36 on the exposed side of the gate 28 and project below the block for subsequent mounting on a circuit board as desired. These tails cooperate with the interference fit between the gates and the recess 24 to assure that the gate is secured in place. The gate prevents leads inserted deeply into the lower terminal cavities 14 from engaging tails 56 and forming short circuit connections between the two terminals. Cavity 38 permits limited overinsertion of the leads.

While I have illustrated and described a preferred embodiment of my invention, it is understood that this is capable of modification, and I therefore do not wish to be limited to the precise details set forth, but desire to avail myself of such changes and alterations as fall within the purview of the following claims.

I claim:

1. A block for receiving a terminal or like member including a body molded of rigid filled thermo-plastic material and having a terminal cavity with an open end formed therein; and a rigid gate integrally molded as a part of the body and joined to the body adjacent the open end of the cavity by a hinge portion, the hinge portion including a first flexible resin rich layer on a surface of the hinge portion adjacent the open end of the cavity to permit rotation of the gate about the flexible layer to a closed position blocking the open end of the cavity and a tensile break extending through both a second flexible resin rich layer on a surface of the hinge portion spaced from said first flexible resin rich layer and a rigid central resin-filler composite located between such layers.

2. A block as in claim 1 including a plurality of cavities arranged in a first row and wherein the gate includes a rigid strip extending along the row of cavities and including, a plurality of spaced hinge portions joining the body and the gate.

3. A block as in claim 2 including a gate-receiving recess at the open ends of the cavities for receiving the gate in the closed position.

4. A block as in claim 2 wherein said body includes a second row of cavities located above said first row of cavities and wherein one side of the gate includes grooves for receiving tails extending from the second row of cavities.

5. A block as in claim 1 wherein the resin-filler composite comprises glass fibers.

6. A block for receiving a terminal or like member including a body molded of filled thermo-plastic material and having a terminal or member-receiving cavity therin with an open end, an integral molded rigid gate extending away from the body adjacent the open end of the cavity, a hinge portion joining said gate and body, a flexible surface resin rich layer adjacent the open end of the cavity extending from the body across the hinge portion and to the gate permitting rotation of the gate about the layer to a closed position obstructing the adjacent end of the cavity, and a tension-rupturable portion of the hinge portion including a second flexible resin surface layer and a rigid composite resin-filler layer located between the two resin layers whereby upon movement of the gate toward the closed position the gate is subject to tensile forces and the tension-rupturable portion breaks permitting rotation of the gate to the closed position, about said first recited flexible resin rich layer.

7. A block as in claim 6 wherein said resin filler layer comprises glass fibers.

8. The method of closing an open ended recess in a block molded from filled thermo-plastic material, the block including a cavity having an open end and a rigid integral gate extending away from the block adjacent the open cavity end, comprising the steps of:

a. Positioning an article in the recess through the open end;

b. Subjecting the portion of the gate adjacent the block to a tensile force to rupture a resin rich layer on the side of the portion away from the open end of the cavity and a rigid central resin filter composite without rupturing a flexible resin rich surface layer on the side of the portion adjacent the open end of the cavity; and c. Rotating the gate about the remaining flexible surface resin rich layer to a position closing the open end of the cavity.

9. The method of claim 8 wherein the gate is rotated through approximately 180°.

* * * * *